United States Patent [19]

Upatnieks et al.

[11] 4,277,137

[45] Jul. 7, 1981

[54] COHERENT OPTICAL CORRELATOR

[75] Inventors: Juris Upatnieks, Ann Arbor, Mich.; Charles R. Christensen, Athens; Bobby D. Guenther, Huntsville, both of Ala.

[73] Assignee: The United States of America as represented by the Secretary of the Army, Washington, D.C.

[21] Appl. No.: 949,325

[22] Filed: Oct. 6, 1978

[51] Int. Cl.[3] ..... F41G 7/22; F42B 15/02

[52] U.S. Cl. ..... 350/162 SF; 244/3.17

[58] Field of Search ..... 350/162 SF; 340/146.3 Q; 244/3.17; 356/71

[56] References Cited

U.S. PATENT DOCUMENTS

| | | | |
|---|---|---|---|
| 3,597,045 | 8/1971 | Mathisen | 350/162 SF |
| 3,608,994 | 9/1971 | McDonnell | 350/162 SF X |
| 3,627,402 | 12/1971 | Gamblin | 350/162 SF X |
| 3,776,616 | 12/1973 | Douklias | 350/162 SF |
| 3,778,166 | 12/1973 | Pease et al. | 356/71 |
| 3,779,492 | 12/1973 | Grumet | 356/71 |
| 3,802,762 | 4/1974 | Kiemle | 350/162 SF |

*Primary Examiner*—John K. Corbin
*Assistant Examiner*—Bruce Y. Arnold
*Attorney, Agent, or Firm*—Nathan Edelberg; Robert P. Gibson; Robert C. Sims

[57] ABSTRACT

Reference scenes stored in a filter set containing an array of sets of superimposed, holographic, matched filters are optically correlated with input images displayed on an optically-addressed, liquid crystal, light modulator 34. In operation, a selected laser diode is energized to direct a polarized light beam through the collimating lens L1 to the reflecting surface of a polarizing beam splitter 35. After reflecting off the beamsplitter surface, the beam is expanded by positive lens L2 and passed to the liquid crystal modulator. There it is modulated by the input image and reflected; after which it is recollimated by positive lens L2, transmitted by the beamsplitter, and directed to a particular array location of the filter set dependent upon which particular laser diode is energized. The filter set is positioned to be in the back focal plane of lens L4 so that the Fourier-transform of the input image is incident on the particularly located, superimposed matched filter at 31. If the Fourier transformed input image corresponds to one of the superimposed matched filters the incident light beam is diffracted by that particular hologram matched filter to form a spot of light at a predetermined array location of a detector array. The optical correlator finds use as a terminal guidance system in guiding a missile to its target.

2 Claims, 3 Drawing Figures

COHERENT OPTICAL CORRELATOR

DEDICATORY CLAUSE

The invention described herein may be manufactured, used, and licensed by or for the Government for governmental purposes without the payment to us of any royalties thereon.

BACKGROUND OF THE INVENTION

The use of area correlation in terminal guidance requires that the system cross-correlate a stored reference with the observed scene and have the capacity for handling variations in aspect angle, rotation, scale and intensity. This correlation must be made in real time at a low false alarm rate.

Our optical techniques can be used to perform cross-correlation and have the following advantages. An optical processor has an inherently large information capacity. A relatively modest optical system can handle scenes having over $10^7$ resolution elements. Such a system handles two-dimensional data in a parallel and isotropic manner with a response time dictated by the time it takes light to travel the length of the processor, plus the time required for data input and output. An increase in the number of required resolution elements does not increase the response time or size of the optical system.

Optical data processing techniques can be divided into two general categories, incoherent and coherent. Incoherent optical processing operates on the intensity of the images to be correlated, that is, it handles only positive functions. Coherent processing makes use of the phase and amplitude of the images and can therefore handle complex functions. Coherent optical correlators are well known to give distinct auto-correlation and cross-correlation peaks between data having precise scale, orientation, and contrast match. These peaks are generally quite narrow and have a low background level because correlations are performed on the high-frequency content of the input image, such as edges and other details. Correlation time is independent of the number of data points on the reference filter and the input image, although in practice the time required to obtain a correlation is determined by the data read-in time and the correlation read-out time.

In all correlation systems, variations in the input scene when compared to the on-board reference scene can cause a reduction or loss of the correlation signal. The ability of a processor to handle variations in the input scene will determine if a particular correlation technique is successful. The most common scene deviations are scale, rotational orientation, intensity, aspect angle, and overlap. A typical processor can handle errors of $\pm 5\%$ in scale. Larger errors can be handled by using additional reference images or by change in magnification of the input image. Variation in rotational orientation can be reduced by providing attitude control to the missile. A typical optical processor can handle $\pm 2°$ rotational errors. Other compensation techniques for rotational variations include using additional reference images or rotating the input optically, electronically, or digitally. A change of intensity or shading is not a problem for those systems that first obtain the Fourier transform of the scene (such as a coherent processor) for they can bandpass filter the spatial frequencies of the scene before correlation. A small change in aspect angle is a distortion of the scene and can be handled by a nonuniform magnification change across the scene area. Large aspect angle changes require that additional reference scenes be stored on board.

A sensor on board a missile will typically provide a low resolution scene for the terminal guidance system. The use of a low resolution imagery reduces the sensitivity of the system to scale and rotation errors in the input scene while still providing an adequate correlation signal (signal-to-noise ration greater than 15 dB). Additional advantages are also obtained by the use of low resolution imagery. The size of the optical elements required in the processor is reduced and the coherence requirements on the light source for the coherent optical processor are reduced, allowing laser diodes to be used. See Shareck, M. W. and Castle, J. G., Jr., *Area Correlation by Fourier Transform Holography,* Final Report, USA MICOM Contract DAAH01-72-C-0916, University of Alabama in Huntsville, November 1973; and Gara, A. D., "Real-Time Optical Correlation of 3-D Scenes," *Appl. Opt.,* Vol. 16, 1977, p. 149.

SUMMARY OF THE INVENTION

The real time coherent optical processor will operate using realistic, low resolution input imagery. The system incorporates a bank of reference images to provide the capacity for handling variations in aspect, rotation, and scale. This bank is scanned in time so that it can be determined which reference images are providing correlation signals. The input device is an optically addressed image forming light modulator which can be operated by imaging on it an object or scene illuminated with bright artificial light or sunlight or by imaging a television monitor on cathode ray tube image of an object or scene. An array of laser diode light sources is used to interrogate an array of stored reference image transforms by selectively turning on diodes in the array.

DESCRIPTION OF THE PREFERRED EMBODIMENT

A. Image and Filter Format

Correlator configurations are dependent upon the input image size and resolution. It will be assumed that this correlator is to operate on low resolution images with relatively few pixels. As the input data, the image will be assumed to consist of $128 \times 128$ or $1.64 \times 10^4$ pixels and the reference image from which the matched filter is made to consist of $256 \times 256$ or $6.59 \times 10^4$ pixels. Having the reference larger than the input insures that the correlation peak amplitude will not vary due to relative lateral displacement of the image.

For a reasonable balance between input image size and its Fourier transform size, an input image format of 22 pixels/mm which gives an image size of $6 \times 6$ mm and a reference image twice as large will be chosen. If the Fourier transform lens has a 200-mm focal length and laser diodes are used as light sources with $\lambda = 820$ nm, the maximum diameter of the Fourier transform is 3.6 mm for data and 7.2 mm for sampling frequency. For a correlation peak displayed at a distance of 200 mm from the Fourier transform plane, the minimum size of the correlation spot should be approximately 200 μm. The location of this spot should be within an area 6×6 mm in size if the input image is to overlap the reference completely. A detector having a resolution of 100 μm should be sufficient and the area covered need not exceed 6×6 mm. As a minimum, 100μ m detector resolution is needed to detect correlation peaks while 20 μm resolution would provide a much better estimate of the location of the correlation peak, to approximately 1/5 the width of the correlation peak.

Using a cathode ray tube (CRT) or an equivalent input device, scale search can be performed by changing the CRT deflection amplifier gain to change the image size. By changing the horizontal gain as a function of vertical position, small aspect angle changes or distortions can be searched.

B. Filter Multiplexing

Figure 1:
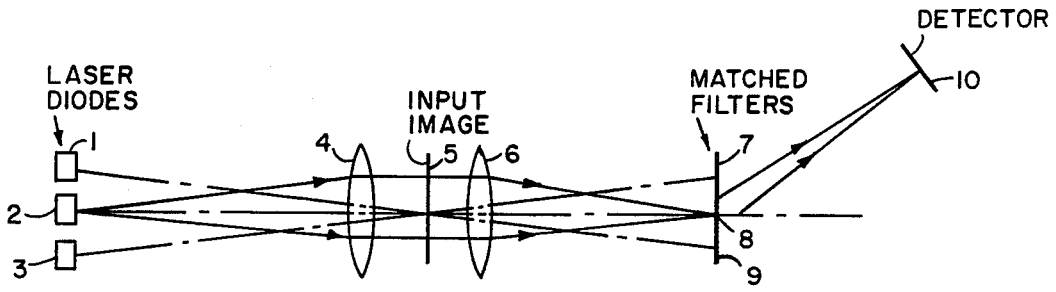
FIG. 1 PRIOR ART
FIG. 1 is a diagramatic showing of a matched filter multiplexing with multiple light sources.

Multiplexing can be performed by the use of several input image illuminating beams and numerous parallel filters at the Fourier transform plane. FIG. 1 shows the basic arrangement. At the left are several light sources 1–3 which can be turned on either one at a time or simultaneously. These sources might be laser diodes, for example. Light from each source passes through lens 4 and 6, the input image 5 and forms a Fourier transform that is separate from those formed by adjacent light sources. A different matched filter 7–9 can be located at each transform location. The correlation from each source can be made to coincide at the output plane or appear at separate locations. If they coincide, then one detector 10 can be used for all filters, and the filters would be used in time sequence. If the correlations appear at separate locations at the output plane, then each correlation would have its own detector and the correlations could be performed simultaneously; the latter arrangement is faster but requires multiple detector arrays. All of the light from each source is used to perform correlations with a corresponding filter. To keep the complexity to a reasonable level, an array of up to 5×5 light sources for a total of 25 parallel processors could be used.

Figure 2:
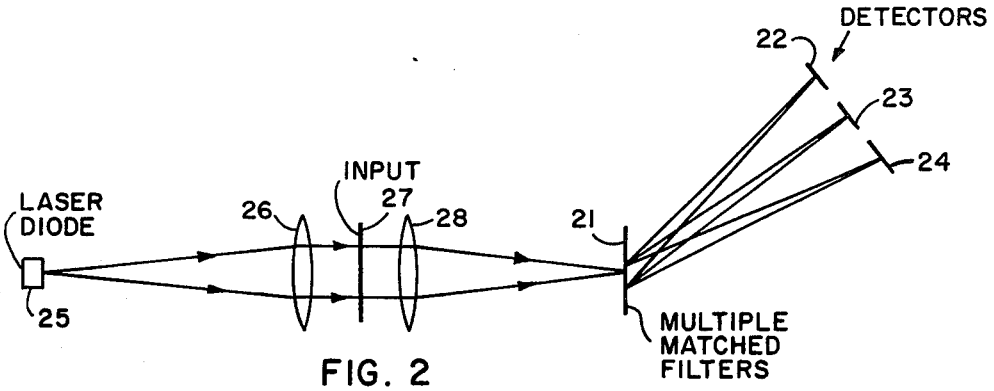
FIG. 2 PRIOR ART
FIG. 2 is a diagramatic showing of a matched filter multiplexing with superimposed filters.

Another method of multiplexing is shown in FIG. 2 and in Vander Lugt, A. and Leith, E. N., "Techniques in Optical Data Processing and Coherent Optics," *Ann N.Y. Acad. Sci.*, Vol. 157, 1969, p. 99. Numerous filters 21 are superimposed at the same location in the Fourier transform plane so that correlation peaks from each are located separately at the output. This arrangement requires multiple detectors 22–24 in the output plane. The number of such superimpositions is limited by space available at the output plane and by the fact that light from laser 25 through lenses 26 and 28 and input image 27 is equally divided between all correlations and this decreases as 1/N, where N is the number of superimposed filters. The use of nine superimposed filters seems to be a realistic maximum number for this method.

Figure 3:
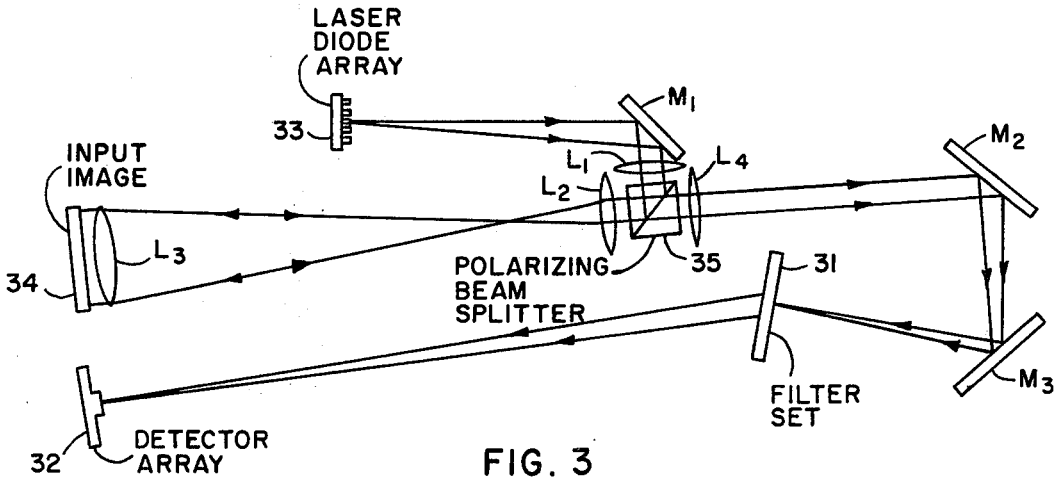
FIG. 3 is a diagramatic showing of the preferred embodiment of the present invention.

Using both multiplexing techniques simultaneously as shown in FIG. 3, a total of 9×25 or 225 different filters 31 could be recorded at the Fourier transform plane. If scale search for ten different image sizes for each of the 225 filters is included, this correlator could perform a total of 2250 different correlations. These 225 filters might include different images, angular orientations, or aspect angles.

C. Estimate of Correlation Time

This optical correlator makes a Fourier transform of the input image and performs correlations almost instantaneously. The readout of data is limited by the rate of scanning the output device and by the light energy used in the processor to charge light detector cells. The time to load the image into the processor is determined both by the scan rate of the sensor or sensor display and by the response time of the light modulator.

Output Detector

As an example, a commercial 100×100 element detector array 32 with elements spaced on 60 μm centers and a 6×6 mm active area can be used. The usable range of sensitivity extends from a minimum of 0.16 ergs/cm$^2$ to a saturation exposure of 8 ergs/cm$^2$. The maximum scan rate of 10 MHz permits one complete output plane scan in 1 msec. The power consumption for a detector array and its associated electronics is approximately 10 W.

Light Sources

A 10-m W laser diode with output at 820 nm and having 4 nm spectral bandwidth can be used in the correlator's laser diode array 33. A typical diode has an emitter area of 2×13 μm and an overall package diameter of 10 mm. Input power is less than 1 W. Its switching time is less than 1 nsec therefore can be considered instantaneous. Its wavelength matches the peak response of the detector array. It is estimated that approximately 10% of its output energy will enter the correlator.

Correlator Input Devices

Several types of input devices 34 using liquid crystal or photoconductor-thermoplastic materials could be employed in the optical correlator. See for example, Grinberg, J., Jacobson, A. J., Bleha, W., Miller, L., Fraas, L., Boswell, D., and Myer, G., "A New Real-Time Non-Coherent to Coherent Light Image Converter the Hybrid Field Effect Liquid Crystal Light Valve," *Opt. Eng.*, Vol. 14, 1975, p. 217; and Grinberg, J., Bleha, W. P., Braatz, P. O., Chow, K., Close, D. H., Jacobson, A. D., Little, M. J., Massetti, N., Murphy R. J., Nash, J. G., and Waldner, M., "Liquid-Crystal Electro-Optical Modulators for Optical Processing of Two-Dimensional Data," *Proceedings* SPIE, Vol. 128, 1977, p. 253. The computational estimates used here will be based on a device using a CRT as the source of the image and using a lens to image the CRT picture onto the image converter. Direct imaging of the live scene would yield similar correlation rates.

Correlation Time

In generation of the input image, it will be assumed that the image data are collected and stored in a digital memory and read onto a CRT which is imaged onto the liquid crystal cell. Thus for a 128×128 point array there are 1.6×10$^4$ points. These can be scanned at a 1.6 MHz rate so that the image is read onto the CRT in 10 msec. Because the image converter 34 response time is 15 msec. and turn-off time is 25 msec, it will be assumed that a usable image exists during a 10 msec period from 20 to 30 msec after the start of the scan, and that an additional 20 msec are needed for a complete image turn-off. During these 10 msec, five sequential sets of correlations, each with nine parallel correlations, can be performed for a total of 45 correlations. Thus, in 50 msec, 45 correlations can be performed at an average rate of 900 correlations/sec.

The data arrangement for the correlator would depend upon factors such as the angular search or scale search required, the storage of multiple targets, and the total operating time for the correlator.

Since the laser diodes 33 require 1 W of power and the liquid crystal input device 34 and detector array 32 a fraction of a watt, the total power consumption should be less than 2 W. This does not include the power requirements of the CRT and computer components, not shown, expected to be used with the correlator. The Charge-Coupled-Device (CCD) addressed liquid crystal moduator under development by Hughes could be used directly in place of the incoherent-to-coherent image converter. With the latter arrangement, the computer could be packaged into 1500-$cm^3$ (0.05-$ft^3$) volume and would probably weigh less than 5 kg (11 lb).

In FIG. 3, current state-of-the-art components are used. The image input device 34 is a Hughes Aircraft liquid crystal modulator. To increase its size, the Fourier transform is magnified by lenses $L_2$ and $L_4$ by the ratio of $f_4/f_2$, where f is the lens focal length. Reflectors $M_1$–$M_3$ are used to reduce the overall size of the correlator. This provides a Fourier transform focal length of 200 mm. The use of the combination $L_2$, $L_3$ allows for the use of a small polarizing beamsplitter 35 and reduces the overall correlator size. The lens combination $L_2$ and $L_3$ also reduces the image size to $6\times6$ mm to the right of lens $L_2$. The preceding lens focal lengths were chosen primarily to achieve a convenient scale and do not represent the minimum possible. See Fienup, J. R., Colburn, W. S., Chang, B. J., Leonard, C. D., "Compact Real-Time Matched Filter Optical Processor," *Proceedings SPIE,* Vol. 188–04, 1977.

The matched filter set 31 consists of an array of $5\times5$ filters each occupying $7.2\times7.2$ mm of space. At each filter location, four or more different filters are superimposed. The correlation peaks from each fall on detector array 32 which has a spectral sensitivity matching the laser diode output. One field of this detector could be allocated for each filter superimposed at one location. For the parameters shown in FIG. 3, the width of the correlation peak can be expected to be approximately 100 $\mu$m.

The light source is an array of laser diodes 33 such as RCA Type C30130. Of the 10-mW output, approximately 10% can be utilized and should give sufficient light output at the detector array 32. Each diode directs the input transform to one superimposed filter set in filter set array 31.

The matched filter array 31 would be constructed on an optical system separate from the correlator, not shown. The filters could either be recorded on a high resolution photographic emulsion, on dielectric materials such as dichromated gelatin for higher efficiency, or on thermoplastic photoconductive recording materials. The latter would be most suitable for operational systems because it is nearly real time and the recording is permanent until erased.

In operating the correlator, an image is input to the modulator at 34 and one laser diode of array 33 is switched on and light travels M1, L1, 35, L2, L3, 34, L3, L2, 35, L4, M2, and M3 to form a Fourier transform of the input image at a corresponding location in the filter set array 31. If the input corresponds to one of the set of reference images stored as superimposed filters at this location, a correlation spot will appear in the corresponding field on detector array 32. The detector field in which the spot lies and the location in the filter set array addressed by the diode provides identification of the reference corresponding to the input. The displacement of the correlation spot from the center of the field on the detector provides an aimpoint correction for the guidance system, not shown.

For further disclosure of the details of this invention, reference may be made to J. Upatnieks, B. D. Guenther, and C. R. Christensen, "Real Time Optical Correlation for Missile Terminal Guidance", U.S. Army Missile Research and Development Command, Redstone Arsenal, AL, January 1978, Report No. H-78-5; and C. R. Christensen, J. Upatnieks, and B. D. Guenther, "Coherent Optical Correlation in Real Time for Terminal Guidance", Proc Army Science Conf., West Point, NY, 20–22 June 1978.

We claim:

1. An optical correlator comprising an array of coherent light sources; an imaging device having an input image thereon; a filter set array having a plurality of filters therein; first means selectively directing one of said light sources through said imaging device so as to form a Fourier transform of the image at a corresponding location in said filter set array; a detector array having a plurality of detectors thereon; said filter set array having stored reference images thereon such that if the input image illuminated by the selected light source corresponds to the reference image, then a correlation spot will appear in a corresponding field of the detector array; said coherent light sources comprises a plurality of laser diodes; and a polarizing beam splitter connected between said laser diodes and said imaging device so as to reflect light from said laser diodes through said imaging devices and to pass reflected light from said imaging device through said beam splitter to said filter set array.

2. An optical correlator as set forth in claim 1 further comprising lenses and reflecting devices for reflecting the light thru said lenses, polarizor beam splitter, filter set array and detector array so as to reduce the overall size of the correlator.

* * * * *